US005606217A

United States Patent [19]

Hirai et al.

[11] Patent Number: 5,606,217

[45] Date of Patent: Feb. 25, 1997

[54] COLOR CATHODE RAY TUBE OF SHADOW MASK TYPE

[75] Inventors: Ryoji Hirai; Yuuichi Inoue, both of Mobara, Japan

[73] Assignee: Hitachi, Ltd., Tokyo, Japan

[21] Appl. No.: 328,886

[22] Filed: Oct. 25, 1994

Related U.S. Application Data

[63] Continuation-in-part of Ser. No. 921,730, Jul. 30, 1992, abandoned.

[30] Foreign Application Priority Data

Jul. 30, 1991 [JP] Japan ..... 3-189772

[51] Int. Cl.[6] ..... H01J 31/00

[52] U.S. Cl. ..... 313/477 R; 313/402

[58] Field of Search ..... 313/477 R, 402

[56] References Cited

U.S. PATENT DOCUMENTS

| | | | |
|---|---|---|---|
| 4,537,321 | 8/1985 | Tokita | 313/477 R |
| 4,924,140 | 5/1990 | Hirai et al. | 313/477 R |
| 5,155,410 | 10/1992 | Wakasono et al. | 313/402 |

FOREIGN PATENT DOCUMENTS

| | | | |
|---|---|---|---|
| 283129 | 9/1988 | European Pat. Off. | 313/402 |
| 311185 | 4/1989 | European Pat. Off. | 313/402 |
| 52-74278 | 6/1977 | Japan | 313/402 |
| 59-215640 | 12/1984 | Japan . | |
| 63-232247 | 9/1988 | Japan . | |

*Primary Examiner*—Sandra L. O'Shea
*Assistant Examiner*—Matthew J. Esserman
*Attorney, Agent, or Firm*—Antonelli, Terry, Stout & Kraus, LLP

[57] ABSTRACT

Curve surface shapes $Z_X$, $Z_Y$ on the long axis and short axis of at least the outer surface of a face plate are approximated by $Z_X=A_1X^2+A_2X^4+A_3X^6$ and $Z_Y=A_4Y^2+A_5Y^4+A_6Y^6$, and the curved surface shapes $P_X$, $P_Y$ of at least the outer surface of the face plate panel at points ($X=X_1$, $Y=Y_1$) of effective screen boundary portions are given by $P_X=A_1X_1^2/(A_1X_1^2+A_2X_1^4+A_3X_1^6)$ and $P_Y=A_4Y_1^2/(A_4Y_1^2+A_5Y_1^4+A_6Y_1^6)$, wherein $0.6<P_X\leqq 0.9$ and $0.6\leqq P_Y\leqq 1.0$ are satisfied. The curvature radii R (mm) of the effective screen boundary portion of the short side and long side satisfy the relationship: 2.0 (42.5 V+45.0)<R≦4.0 (42.5 V+45.0), where the effective diagonal diameter of the face plate panel is V (inches). This enables a flatter periphery, less distorted panel surface and less doming effect.

3 Claims, 6 Drawing Sheets

(a) Sectional view along the long-side.

(b) Sectional view along the short-side.

(a) Sectional view of Fig. 1 taken along the line X-X.

(b) Sectional view of Fig. 1 taken along the line Y-Y.

(a) Sectional view along the long-side.

(b) Sectional view along the short-side.

FIG. 7

(UNIT : μm)

| TUBE \ 1/4 MODEL | | | | | | |
|---|---|---|---|---|---|---|
| Conventional | $A_1X_1^2/(A_1X_1^2+A_2X_1^4)=0.3$ PERIPHERAL R=2003mm | 65 | 76 | 74 | 109 | 75 |
| Present | $A_1X_1^2/(A_1X_1^2+A_2X_1^4+A_3X_1^6)=0.8$ PERIPHERAL R=4242mm | 70 | 90 | 98 | 115 | 88 |

COLOR CATHODE RAY TUBE OF SHADOW MASK TYPE

This application is a continuation-in-part application of U.S. application Ser. No. 07/921,730, filed Jul. 30, 1992, now abandoned, by the same inventors herein, the subject matter of which is incorporated herein by reference.

BACKGROUND OF THE INVENTION

1. Field of the Invention

The present invention relates to a color cathode ray tube of shadow mask type, and particularly to a color cathode ray tube of shadow mask type having a so-called flat face such that the shape of a face plate panel is substantially planar.

2. Prior Art

A cathode ray tube (hereinafter referred to as a color cathode ray tube) used for color image display is constituted by a panel portion which is an image screen, a neck portion for accommodating an electron gun, and a funnel portion coupling the panel portion (face plate panel) to the neck portion, and the funnel portion is equipped with a deflector which deflects the electron beam emitted from the electron gun to scan the fluorescent screen formed on the inner surface of the panel.

Against the inner surface of the face plate panel is installed a shadow mask which is a color selection electrode having a curvature that is similar to the curvature of the inner surface, in order to define the positions at which a plurality of electron beams emitted from the electron gun impinge upon the fluorescent screen.

The electron gun accommodated in the neck portion has various electrodes such as a cathode electrode, a control electrode, a converging electrode and an accelerating electrode, and modulates the electron beam from the cathode electrode with a signal applied to the control electrode, imparts a desired sectional shape and energy thereto through the converging electrode and accelerating electrode, and causes it to impinge upon the fluorescent screen. The electron beam is deflected in the horizontal direction and in the vertical direction by the deflector provided in the funnel portion in the way from the electron gun to the fluorescent screen, and forms an image on the fluorescent screen (see, for example, Japanese Patent Laid-Open No. 215640/1984).

There has been a tendency for recent color cathode ray tubes to have a so-called flat face, namely the shape of the face plate panel on which an image is formed is substantially planar.

Flatness of the face plate panel of color cathode ray tubes is greatly affected by the curvature of the peripheral portion (periphery of the face plate panel). Therefore, the flatness of the face plate panel increases with a decrease in the curvature of the peripheral portion. However, the shadow mask has a flat shape, too, to meet the curvature of the face plate panel resulting in an increase in the landing error (doming phenomenon) due to the thermal expansion of the shadow mask, causing the poor image reproduction.

A color cathode ray tube which has realized both the flattening of the face plate panel and improvements in the doming phenomenon is disclosed in Japanese Patent Laid-Open No. 232247/1988.

According to the invention disclosed in the above publication, the shapes of the inner and outer surfaces of the face plate panel are expressed by three-dimensional spatial equations in which the X-axis is the long axis (horizontal axis), the Y-axis the short axis (vertical axis) and the Z-axis the axis of the tube. That is, curved surface shapes $Z_X$, $Z_Y$ on the X-axis and Y-axis are approximated by $Z_X=A_1X^2+A_2X^4$ and $Z_Y=A_3Y^2+A_4Y^4$, and curved surface shapes $P_X$, $P_Y$ at a point ($X=X_1$, $Y=Y_1$) of an effective screen boundary portion which is the boundary between the effective screen portion and the surrounding peripheral portion are approximated by $P_X=A_1X_1^2/(A_1X_1^2+A_2X_1^4)$ and $P_Y=A_3Y_1^2/(A_3Y_1^2+A_4Y_1^4)$, wherein the above constants $A_1$, $A_2$, $A_3$ and $A_4$ are set to satisfy $0.3 \leqq P_X$ ($X=X_1$) $\leqq 0.6$ and $0.95 \leqq P_Y$ ($Y=Y_1$) $\leqq 1.0$. Furthermore, the effective screen boundary portions on the outer surface of the face plate panel on the short side and on the long side are formed to have arcuate shapes with nearly an equal curvature and that a relationship $1.5(42.5\ V+45.0) \leqq R \leqq 2.0(42.5\ V+45.0)$ is satisfied when the radius of curvature R(mm) thereof has an effective diagonal diameter of V (inches), to thereby reduce the doming of the shadow mask and to improve the strength, image reflected on the surface and flatness of the face plate.

In conventional color cathode ray tubes having the above mentioned curved surface shapes, however, when it is attempted to further flatten the face plate panel causing the radius of curvature of the peripheral portion to lie outside the above mentioned R (mm) range, the image reflected on the outer surface is greatly distorted and, in particular, local distortion increases greatly. Moreover, a landing error increases due to doming of the shadow mask, seriously impairing the quality of the image that is displayed.

OBJECT OF THE INVENTION

The object of the present invention is to solve the aforementioned problems of the prior art, and especially to provide a color cathode ray tube of shadow mask type which has more smooth face curvature of the panel even the flatness of the peripheral area.

SUMMARY OF THE INVENTION

In order to achieve the above object, the present invention provides a color cathode ray tube of shadow mask type comprising an effective screen portion and a peripheral portion surrounding the effective screen portion, and having a face plate panel of a rectangular shape with a long axis and a short axis, wherein when the curved surface shapes of at least the outer surface of the face plate panel are expressed by three-dimensional spatial equations in which the X-axis is the long axis of the rectangular face plate panel, the Y-axis is the short axis thereof and the Z-axis is the tubular axis thereof, the curved surface shapes $Z_X$ and $Z_Y$ on the long axis and on the short axis are approximated by, $$Z_X=A_1X^2+A_2X^4+A_3X^6$$

$$Z_Y=A_4Y^2+A_5Y_4+A_6Y^6$$

and when the curved surface shapes $P_X$ and $P_Y$ of at least the outer surface of the face plate panel was given by, $$P_X=A_1X_1^2/(A_1X_1^2+A_2X_1^4+A_3X_1^6)$$

$$P_Y=A_4Y_1^2/(A_4Y_1^2+A_5Y_1^4+A_6Y_1^6)$$

at a point ($X=X_1$, $Y=Y_1$) of an effective screen boundary portion which is a boundary between the effective screen portion and the peripheral portion, the constants $A_1$, $A_2$, $A_3$, $A_4$, $A_5$ and $A_6$ are set to satisfy, $$0.6<P_X(X=X_1)\leqq 0.9$$

$$0.6\leqq P_Y(X=Y_1)\leqq 1.0.$$

Moreover, the short-side effective screen boundary portion and the long-side effective screen boundary portion on the outer surface of the face plate panel have arcuate shapes, and the equivalent radii R(mm) of the arcs satisfy a relationship, $$2.0\ (42.5\ V+45.0)<R\leqq 4.0\ (42.5\ V+45.0)$$

when the effective diagonal diameter of the face plate panel is V (inches).

By setting the inner and outer surface shapes $Z_X$, $Z_Y$ of the face plate panel, the curved surface shapes $P_X$, $P_Y$ at a point on the effective screen boundary, and the radius of curvature R to lie within the aforementioned ranges, it is possible to have more smooth face curvature and the flatter peripheral portion of the panel and less doming effect at the same time.

BRIEF DESCRIPTION OF THE DRAWINGS

FIG. 2(*b*) is a cross sectional view taken along the line Y—Y shown in FIG. 1;

FIG. 3(*b*) is a cross sectional view along the short side effective screen boundary 41 of FIG. 1;

FIG. 7 shows comparisons of the doming phenomenom between conventional panel surfaces and the present invention.

DESCRIPTION OF THE PREFERRED EMBODIMENT

The color cathode ray tube of shadow mask type of the present invention will now be definitely described by way of an embodiment.

Figure 1:
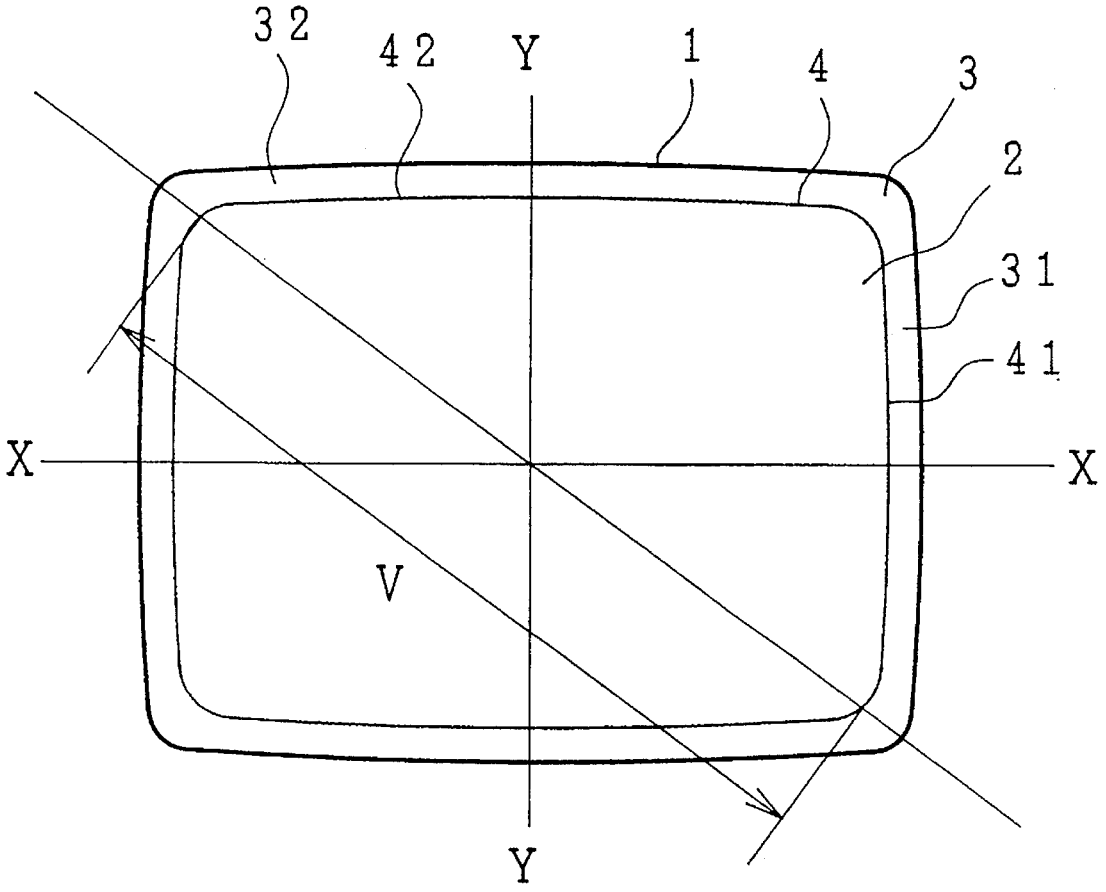
FIG. 1 is a front view of a face plate panel of a color cathode ray tube of shadow mask type according to the present invention.
Figure 2A:
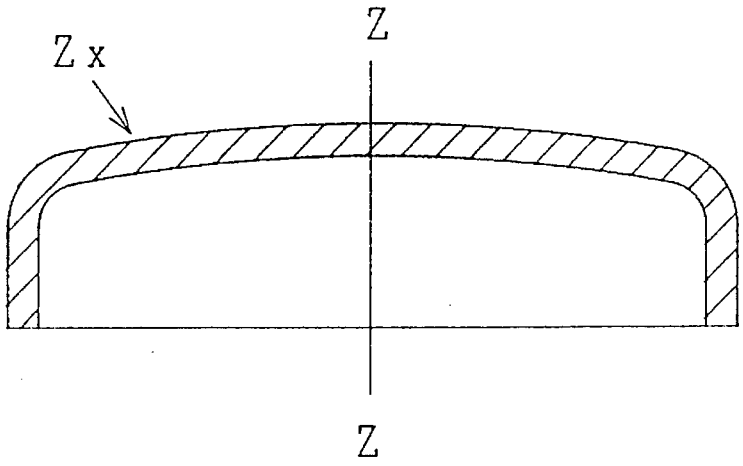
FIG. 2(*a*) is a cross sectional view taken along the line X—X shown in FIG. 1
Figure 2B:
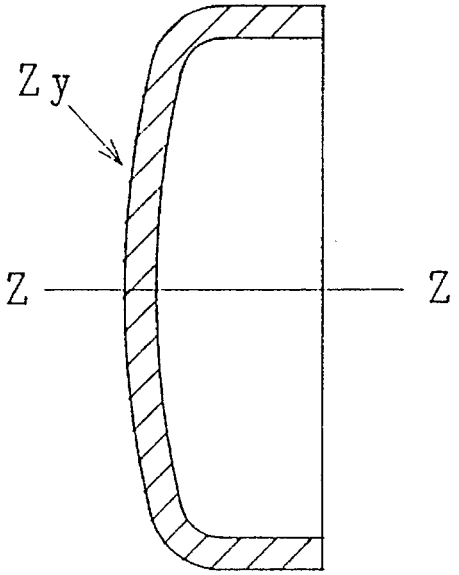

FIG. 1 is a front view of a face plate panel of the color cathode ray tube of shadow mask type of an embodiment according to the present invention, FIG. 2(*a*) is a sectional view of FIG. 1 taken along the line X—X and FIG. 2(*b*) is a sectional view taken along the line Y—Y. Reference numeral 1 denotes a face plate panel, 2 denotes an effective screen portion, 3 denotes a peripheral portion, 31 denotes a short-side peripheral portion, 32 denotes a long-side peripheral portion, 4 denotes an effective screen boundary portion, 41 denotes a short-side effective screen boundary portion which is substantially parallel to Y—Y, 42 denotes a long-side effective screen boundary portion which is substantially parallel to X—X, X—X denotes the long axis (X-axis), Y—Y denotes the short axis (Y-axis), and V denotes the diagonal length (inches).

In FIGS. 1 and 2(*a*), 2(*b*), the face plate panel 1 has a nearly rectangular shape with the X-axis (X—X) as the long axis and the Y-axis (Y—Y) as the short axis, has an effective screen portion 2 with a fluorescent surface consisting of fluorescent materials of three colors formed on the inner surface thereof, the outer surface and the inner surface thereof having nearly the same shape, and an image being displayed as the electron beam impinges on the effective screen portion 2.

The peripheral portion 3 consisting of the short-side peripheral portion 31 and the long-side peripheral portion 32 on which no image is displayed surrounds the effective screen portion 2 to form a surface that is continuous to a skirt portion which couples to a funnel portion that is not shown.

The outer surface of the face plate panel according to the present invention is generally expressed by the following equation, $$Z=A_1X^2+A_2X^4+A_3X^6+A_4Y^2+A_5Y^4+A_6Y^6+A_7X^2Y^2+A_8X^4Y^2+A_9X^6Y^2+A_{10}X^2Y^4+A_{11}X^4Y^4+A_{12}X^6Y^4+A_{13}X^2Y^6+A_{14}X^4Y^6+A_{15}X^6Y^6,$$

where Z denotes a quantity which, when the center of the panel is assumed to be zero, represents how much the outer surface falls compared with the center as it goes away from the center. As represented by the above equation, the curved surface Z is found depending upon fifteen coefficients $A_1$ to $A_{15}$. As many as fifteen coefficients means that there are as many as fifteen variables which, in other words, means that a great amount of evaluation is needed to select optimum coefficients making it very difficult to realize the cathode ray tube.

The present invention is based on the discovery that the coefficients of curved surface equation on the X-axis and Y-axis as well as an equivalent curvature of the peripheral portion play important roles for flattening the peripheral portion of the panel and more smooth curvature of the panel surface and less doming. According to the invention, the peripheral portion is set as follows:

When the effective diagonal diameter is V (inches) according to the present invention, the radii of curvature R(mm) of the short side 41 and the long side 42 of effective screen boundary portions of the outer surface of the face plate panel is set within a range of $2.0\ (42.5\ V+45.0)<R\leqq 4.0\ (42.5\ V+45.0)$.

Figure 3A:
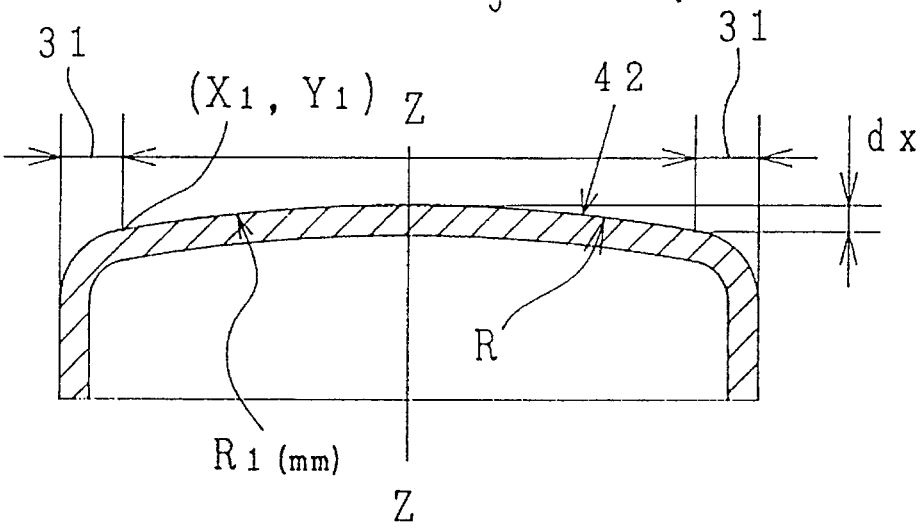
FIG. 3(*a*) is a cross sectional view along the long side of effective screen boundary 42 of FIG. 1.
Figure 3B:
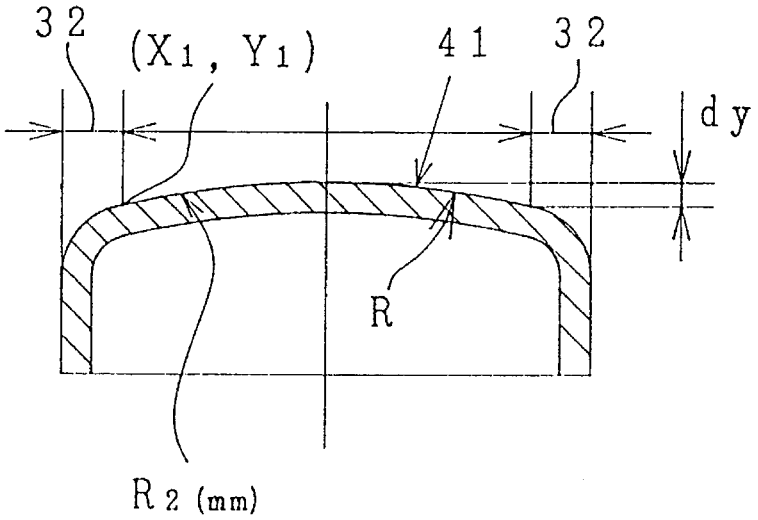

Here, the equivalent radii is defined as described below. That is, the long side $R_1$ in FIG. 3(*a*) is given by $R_1=(dx^2+x_1^2)/2dx$, and the short side $R_2$ in FIG. 3(*b*) is given by $R_2=(dy^2+y_1^2)/2dy$. Because the radii of curvature of long side 42 and short side 41 are not circular, the curvature differs from place to place. Therefore, above equivalent radii is something like a mean radius calculated from the difference of the amount Z between the boundaries of effective area of diagonal and long axis or of diagonal and short axis.

If the radius of curvature long side 42 or short side 41 is set so large, in other words the panel periphry is made flat, the conventional surface according to Japanese Laid Open No. 215640/1984 or U.S. Pat. No. 4,924,140, the surface of the panel would be distorted unnaturally.

This invention, as described above, introduces 6th power for the panel surface and defines certain relations among the coefficients especially on the X-axis and Y-axis.

According to the invention:

the curve on the X-axis is expressed as $$Z_x=A_1X^2+A_2X^1+A_3X^6$$

the curve on the Y-axis is expressed as $$Z_y=A_4Y^2+A_5Y^4+A_6Y^6$$

Further, $P_x$, $P_y$ are defined as:

$$P_x=A_1X_1^2/(A_1X_1^2+A_2X_1^4+A_3X_1^6)$$

$$P_y=A_4Y_1^2/(A_4Y_1^2+A_5Y_1^4+A_6Y_1^6)$$

where;

$X_1$ is the boundary of the effective area on the X-axis shown in FIG. 1.

$Y_1$ is the boundary of the effective area on the Y-axis shown in FIG. 1.

The feature of the invention is to set $P_x$ and $P_y$ as:

$$0.6<P_x\leqq 0.9$$

$$0.6\leqq P_y\leqq 1.0$$

By the introduction of 6th power and setting $P_x$ and $P_y$ as above, the distortion of the panel surface will be relieved even along the flatness of the long side 42 and short side 41.

The point of the present invention is that, even with the 6th power being introduced, the value of $P_x$ is set bigger than the conventional panel surface.

FIG. 7 is an analytical comparison of doming effect between the conventional panel face and the present invention. 27 V" square screen tube is used for this comparison. In this simulation, a model face plate in size of ¼ of said tube is prepared. The shaded region of FIG. 7 is heated to raise the temperature by 15° C. The magnitude of doming (in micron) at the blackened points are shown in the table. Thanks to the introduction of 6th power, the doming phenomenon is not significantly deteriorated in the present invention even with the bigger value of $P_x$.

The following is an example comparison of the conventional panel and present invention.

(1) 27 V" conventional panel:

$$Z=A_1X^2+A_2X^4+A_3Y^2+A_4Y^4+A_5X^2Y^2+A_6X^4Y^2+A_7X^2Y^4+A_8X^4Y^4$$

$A_1=0.1125\ X\ 10^{-3}$ $A_2=0.3505\ X\ 10^{-8}$ $A_3=0.4456\ X\ 10^{-3}$ $A_4=0.1061\ X\ 10^{-9}$ $A_5=0.5014\ X\ 10^{-8}$ $A_6=-0.1087\ X\ 10^{-12}$ $A_7=-0.4394\ X\ 10^{-13}$ $A_8=0.6690\ X\ 10^{-18}$ $X_1=270.4,\ Y_1=202.8$

Px=0.3050, Py=0.9903

Curvature radius R on the long side=1959 mm. Curvature radius R on the short side=2003 mm. Effective diagonal diameter V is 676 mm=26.61 inch 42.5 V+45=1176 mm.

The local radius of curvature along the diagonal axis is as follows:

| point along the diagonal axis (mm) | 33.8 | 57.8 | 90.7 | 135.2 | 169.8 | 202.8 | 236.6 | 270.4 | 304.2 | 338.0 |
|---|---|---|---|---|---|---|---|---|---|---|
| raidius of curvature (mm) | 2002 | 1682 | 1384 | 1187 | 1105 | 1159 | 1465 | 2840 | −8669 | −1492 |

(2) 27 V" present invention;

$$Z=A_1X^2+A_2X^4+A_3X^6+A_4Y^2+A_5Y^4+A_6Y^6+A_7X^2Y^2+A_8X^4Y^2+A_9X^6Y^2+A_{10}X^2Y^4+A_{11}X^4Y^4+A_{12}X^6Y^4+A_{13}X^2Y^6+A_{14}X^4Y^6+A_{15}X^6Y^6$$

$A_1=0.2118\ X\ 10^{-3}$ $A_2=0.5116\ X\ 10^{-9}$ $A_3=0.2197\ X\ 10^{-14}$ $A_4=0.3211\ X\ 10^{-3}$ $A_5=0.8485\ X\ 10^{-9}$ $A_6=0.9530\ X\ 10^{-14}$ $A_7=-0.2039\ X\ 10^{-8}$ $A_8=-0.1149\ X\ 10^{-13}$ $A_9=0.0$ $A_{10}=-0.1855\ X\ 10^{-13}$ $A_{11}=-0.5404\ X\ 10^{-20}$ $A_{13}=0.0$ $A_{13}=0.2212\ X\ 10^{-18}$ $A_{14}=-0.2495\ X\ 10^{-23}$ $A_{15}=0.1290\ X\ 10^{-28}$ $X_1=270.4,\ Y_1=202.8$

Px=0.8116, Py=0.8629

Curvature radius R on the long side=4242 mm. Curvature radius R on the short side=4242 mm. Effective diagonal diameter V is 676 mm=26.61 inches 42.5 V+45=1176 mm

| point along the diagonal axis (mm) | 33.8 | 57.8 | 90.7 | 135.2 | 169.8 | 202.8 | 236.6 | 270.4 | 304.2 | 338.0 |
|---|---|---|---|---|---|---|---|---|---|---|
| radius of curvature (mm) | 2000 | 2033 | 2104 | 2242 | 2509 | 3064 | 4520 | 2840 | −8076 | −2756 |

According to the present invention, even the curvature radius R on the periphery is larger in the present invention than in the conventional art, the differentiation of the curvature along the diagonal axis is smaller than the conventional one or inverse warping phenomenon is more relieved than in the conventional one.

The above description is about the outer surface of the panel. The inner surface of the panel is not completely the same as the outer surface because of the difference of glass thickness. However, the same principle can be applied to the inner surface of the panel.

Figure 4:
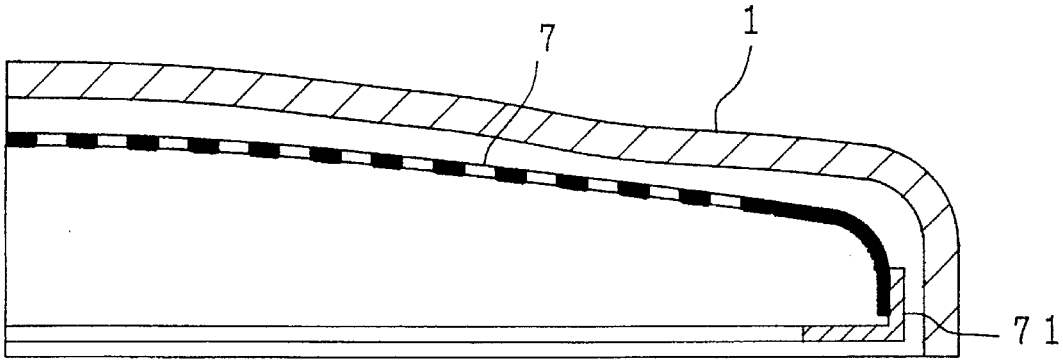
FIG. 4 is a cross sectional view of the face plate panel and the shadow mask of the color cathode ray tube of shadow mask type in a diagonal direction of the screen according to one embodiment of the present invention.
Figure 5:
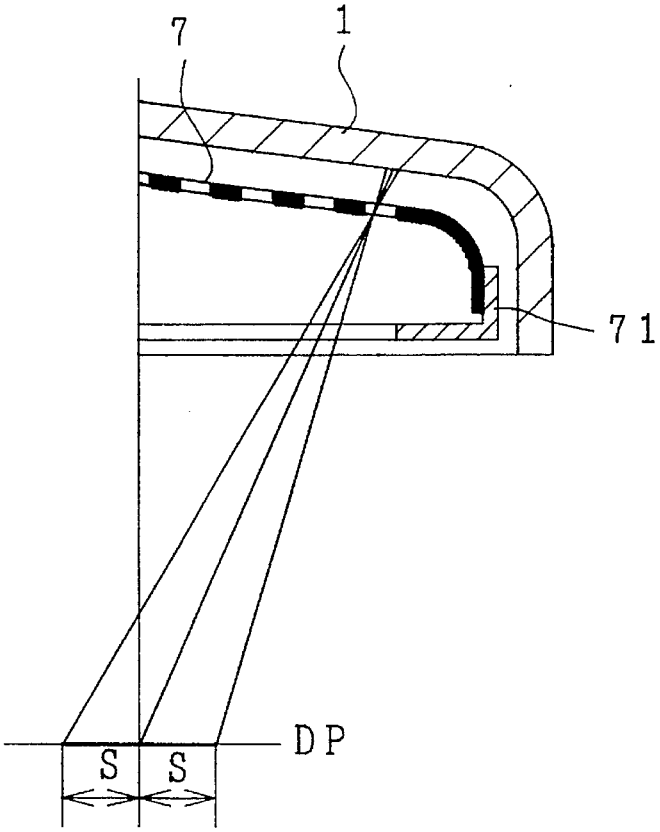
FIG. 5 is a diagram for illustrating the relationship between the characteristics of the deflecting yoke and the curved surface of the shadow mask.

Generally, the shadow mask is designed similarly as the inner surface of the panel. Therefore, the present invention can also be applied to the shadow mask. The shadow mask is made of perforated thin metal and the mechanical strength is weak. Smooth curvature is important from the view point of the mechanical strength, too. FIG. 4 shows that the shadow mask avoid inverse warping even though the panel surface has inverse warping in the diagonal direction. The curve of the shadow mask can be made different from the inner surface of the panel by properly designing the pitch of holes or slots of the shadow mask. The characteristics of deflection yoke also play an important role for determining the shape of the curved surface of the shadow mask. This is illustrated in FIG. 5 where symbol DP denotes a deflecting plane of the deflecting yoke. An optimum distance between the shadow mask and the inner surface of the panel is determined by a value S which is given largely by the distance of the electron gun. However, the effective value S undergoes a change depending upon the characteristics of the deflecting yoke. By selecting the characteristics of the deflecting yoke, therefore, it is possible to vary the curved surfaces of the shadow mask.

Figure 6:
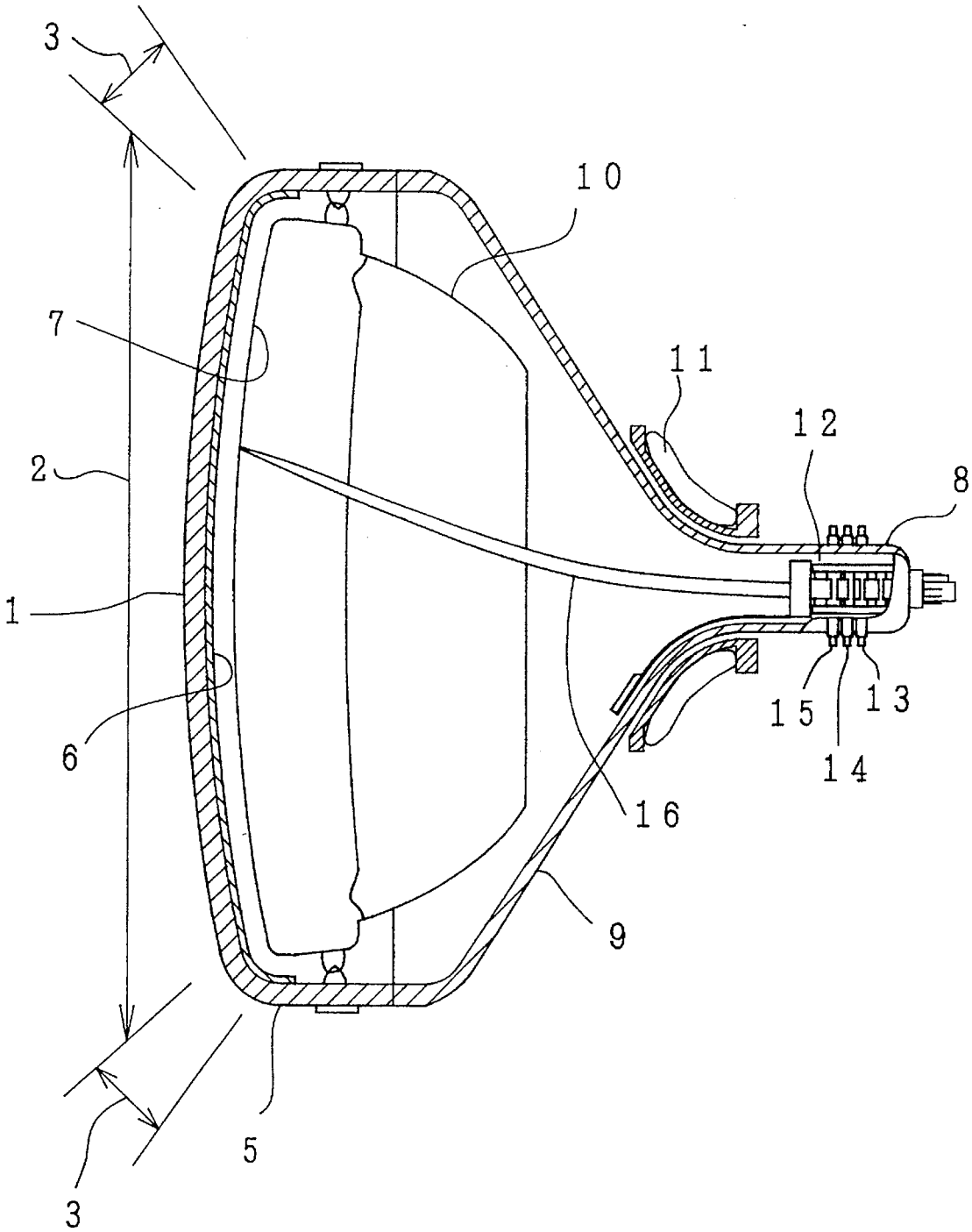
FIG. 6 is a sectional view for illustrating the structure of the shadow mask-type color cathode ray tube according to the present invention.

FIG. 6 is a sectional view illustrating the structure of a color cathode ray tube of shadow mask type according to the present invention, wherein reference numeral 1 denotes a face plate panel, 2 denotes an effective screen portion, 3 denotes a peripheral portion, 5 denotes a panel skirt portion, 6 denotes a fluorescent surface, 7 denotes a shadow mask, 8 denotes a neck portion, 9 denotes a funnel portion, 10 denotes an magnetic shield, 11 denotes a deflecting yoke, 12 denotes an electron gun, 13 denotes a purity adjusting magnet, 14 denotes a magnet for adjusting the center beam static convergence, 15 denotes a magnet for adjusting a side beam static convergence, and 16 denotes an electron beam.

The outer surface and inner surface of the face plate panel 1 are formed in a curved shape as described above and, as required, one or more layers containing $SnO_2$ and $InO_3$ are formed on the outer surface of the face plate panel 1 to prevent reflection and charging. Moreover, an electrically conductive thin film consisting of graphite, titanium dioxide or the like is deposited on the inner surface of the funnel 9.

The shadow mask 7 in this case is formed in a shape which profiles the curved surface shape of the face plate panel 1, i.e., has the similar curved surface as the curved surface of the face plate panel 1. That is, the shadow mask 7 has a curvature of peripheral portion which is greater than that of the prior counterparts, and exhibits an increased rigidity, a decreased spring back at the time of press working, and a decreased doming phenomenon in operation.

Here, the magnetic shield 10 primarily shuts off the effect of earth magnetism.

According to the present invention as described above, there is provided a color cathode ray tube of shadow mask type having excellent functions, capable of flattening the face plate panel, decreasing the distortion of an image reflection of an image reflected on the surface caused chiefly by the curved surface of the peripheral portion, decreasing the doming phenomenon of the shadow mask, and displaying an image of high quality.

We claim:

1. A color cathode ray tube of shadow mask type, comprising:

a face plate panel with a long axis and a short axis having an effective screen portion and a peripheral portion, wherein when the curved outer surface of said face plate panel is expressed by three-dimensional spatial equations in which the X-axis is the long axis of said face plate panel, the Y-axis is the short axis thereof and the Z-axis is the tube axis thereof, the curved outer surface $Z_X$ and $Z_Y$ on the long axis and the short axis are approximated by, $$Z_X=A_1X^2+A_2X^4+A_3X^6$$

$$Z_Y=A_4Y^2+A_5Y^4+A_6Y^6$$

and when $P_X$ and $P_Y$ of the curved outer surface are defined by, $$P_X=A_1X_1^2/(A_1X_1^2+A_2X_1^4+A_3X_1^6)$$

$$P_Y=A_4Y_1^2/(A_4Y_1^2+A_5Y_1^4+A_6Y_1^6)$$

at points ($X=X_1$, $Y=Y_1$) which are boundary portions of the effective screen portion on the X-axis and the Y-axis respectively, and the constants $A_1$,$A_2$,$A_3$,$A_4$,$A_5$ and $A_6$ are set to satisfy $$0.6<P_X(X=X_1)\leqq 0.9$$

$$0.6\leqq P_Y(Y=Y_1)\leqq 1.0,$$

the curvature radii R (mm) on the boundary portion of the effective screen portion at the short side and at the long side satisfies the relationship:

$$2.0(42.5\ V+45)mm<R\leqq 4.0(42.5\ V+45)mm$$

when the effective diagonal diameter of said face plate panel is V, wherein V is measured in inches.

2. A color cathode ray tube of shadow mask type, comprising:

a face plate panel with a long axis and a short axis having an effective screen portion and a peripheral portion, wherein when the curved inner surface of said face plate panel is expressed by three-dimensional spatial equations in which the X-axis is the long axis of said face plate panel, the Y-axis is the short axis thereof and the Z-axis is the tube axis thereof, the curved inner surface $Z_X$ and $Z_Y$ on the long axis and on the short axis are approximated by, $$Z_X=A_1X^2+A_2X^4+A_3X^6$$

$$Z_Y=A_4Y^2+A_5Y^4+A_6Y^6$$

and when $P_X$ and $P_Y$ of the curved inner surface are defined by, $$P_X=A_1X_1^2/(A_1X_1^2+A_2X_1^4+A_3X_1^6)$$

$$P_Y=A_4Y_1^2/(A_4Y_1^2+A_5Y_1^4+A_6Y_1^6)$$

at points ($X=X_1$, $Y=Y_1$) which are boundary portions of the effective screen portion on the X-axis and the Y-axis respectively, and the constants $A_1$,$A_2$,$A_3$,$A_4$,$A_5$ and $A_6$ are set to satisfy $$0.6<P_X(X=X_1)\leqq 0.9$$

$$0.6 \leqq P_Y(Y=Y_1) \leqq 1.0,$$

the curvature radii R (mm) on the boundary portion of the effective screen portion at the short side and at the long side of the inner surface of said face plate panel satisfies the relationship:

$$2.0(42.5\ V+45)mm < R \leqq 4.0(42.5\ V+45)mm$$

when the effective diagonal diameter of said face plate panel is V, wherein V is measured in inches.

3. A color cathode ray tube of shadow mask type, comprising:

a face plate panel with a long axis and a short axis having an effective screen portion and a peripheral portion;

a shadow mask, with a long axis and a short axis having a curved surface, which includes a perforated effective area and a peripheral portion;

wherein when the curved surface of said shadow mask is expressed by three-dimensional spatial equations in which the X-axis is the long axis of the shadow mask, the Y-axis is the short axis thereof and the Z-axis is the tube axis thereof, the curved surface $Z_X$ and $Z_Y$ on the long axis and on the short axis are approximated by $$Z_X = A_1X^2 + A_2X^4 + A_3X^6$$

$$Z_Y = A_4Y^2 + A_5Y^4 + A_6Y^6,$$

and when $P_X$ and $P_Y$ of the curved surface are defined by $$P_X = A_1X_1^2/(A_1X_1^2 + A_2X_1^4 + A_3X_1^6)$$

$$P_Y = A_4Y_1^2/(A_4Y_1^2 + A_5Y_1^4 + A_6Y_1^6),$$

at points ($X=X_1$, $Y=Y_1$) which are boundary portions of the effective area on the X-axis and the Y-axis respectively, and the constants $A_1, A_2, A_3, A_4, A_5$ and $A_6$ are set to satisfy $$0.6 < P_X(X=X_1) \leqq 0.9$$

$$0.6 \leqq P_Y(Y=Y_1) \leqq 1.0,$$

the curvature radii R (mm) on the boundary portion of the effective area portion at the short side and at the long side satisfies the relationship:

$$2.0(42.5\ V+45)mm < R \leqq 4.0(42.5\ V+45)mm$$

when the effective diagonal diameter of said shadow mask is V, wherein V is measured in inches.

* * * * *